US005724940A

United States Patent [19]

Hoffmann et al.

[11] Patent Number: 5,724,940

[45] Date of Patent: Mar. 10, 1998

[54] METHOD FOR CONTROLLING AN INTERNAL COMBUSTION ENGINE IN OVERRUN MODE

[75] Inventors: Christian Hoffmann, Regensburg; Achim Koch, Tegernheim, both of Germany

[73] Assignee: Siemens Aktiengesellschaft, Munich, Germany

[21] Appl. No.: 777,932

[22] Filed: Dec. 23, 1996

[30] Foreign Application Priority Data

Dec. 21, 1995 [DE] Germany ..... 195 48 054.6

[51] Int. Cl.[6] ..... F02D 43/00

[52] U.S. Cl. ..... 123/325

[58] Field of Search ..... 123/325, 326, 123/333, 332, 493, 481

[56] References Cited

U.S. PATENT DOCUMENTS 5,020,495 6/1991 Plapp ..... 123/326

5,136,996 8/1992 Kushi et al. ..... 123/332

5,243,948 9/1993 Schnaibel et al. ..... 123/492

FOREIGN PATENT DOCUMENTS 2736306 3/1978 Germany .

3323723A1 1/1985 Germany .

4100736A1 7/1991 Germany .

OTHER PUBLICATIONS

Patent Abstracts of Japan No. 62–168950 (Minoru), dated Jul. 25, 1987.

*Primary Examiner*—Andrew M. Dolinar

*Attorney, Agent, or Firm*—Herbert L. Lerner; Laurence A. Greenberg

[57] ABSTRACT

An internal combustion engine is constantly monitored for overrun mode. When the overrun mode is detected, the fuel injection to the cylinders is shut off. After the shutoff of fuel injection has been accomplished, the ignition is shut off as well, but only after the (complete) degradation of a fuel wall film in the intake tube. This increases the service life of the ignition system (ignition coil, ignition end stages, spark plugs) and reduces the consumption of electrical energy.

7 Claims, 2 Drawing Sheets

METHOD FOR CONTROLLING AN INTERNAL COMBUSTION ENGINE IN OVERRUN MODE

BACKGROUND OF THE INVENTION

1. Field of the Invention

The invention relates to internal combustion engines, and more particularly to a method of controlling an internal combustion engine with at least one cylinder and at least one intake tube in the overrun mode, wherein, after the overrun mode has been detected, the fuel supply to the at least one cylinder is shut off.

2. Description of the Related Art

To save fuel in internal combustion engines, it has been known to interrupt the supply of fuel to the cylinders during the overrun mode (U.S. Pat. No. 4,644,922 to Glöckler et al., based on German patent disclosure DE 33 23 723 A1). An overrun mode of an engine exists whenever the throttle valve is closed at engine speeds above the idling rpm range, or if the engine has a higher rpm than corresponds to the position of the throttle valve in the case of an Otto engine or the injected fuel quantity in a Diesel engine.

Since in the overrun mode no work output by the engine is desired, fuel economy can be attained by interrupting the fuel supply. On the other hand, because of the fuel interruption, a certain cooling down of the engine and thus at the end of the overrun mode a worsening of exhaust gas behavior for a certain period of time, as well as sacrifices in ride comfort under some circumstances, must also be taken into the bargain. In so-called intake-tube injection of the fuel, not all the fuel quantity injected by the injection valves directly reaches the combustion chambers of the cylinders; instead, a certain portion of the fuel injected per cycle sticks to the wall surface of the intake tube, and thus in the final analysis is not immediately available for that combustion cycle.

In contrast to steady-state events of the engine, in which the fuel wall film deposited on the inner wall of the intake tube is hardly a problem, the wall film adulterates the actual intended fuel metering to a cylinder in non-steady-state events, and it must be taken into account in the control of the engine.

A fuel regulating system for an internal combustion engine has become known from German patent disclosure DE 41 00 736 A1, in which an injection device injects fuel into an intake conduit that communicates with a combustion chamber. The quantity of the proportion of fuel injected and supplied directly by the injection device and entering the combustion chamber is estimated. The quantity of the subsequent fuel portion that was located on the wall surface of the intake conduit, has evaporated, and enters the combustion chamber together with the directly supplied fuel portion is also estimated. The fuel quantity to be injected is determined on the basis of the estimated quantities of the directly supplied fuel portion and the subsequent fuel portion, so that the sum of these two is a desired fuel quantity to be injected into the combustion chamber.

To that end, an evaporation sensor is provided, which detects at least one of the factors that control the extent of evaporation of the fuel located on the wall surface. A variation device increases the estimated quantity of at least one of the two fuel portions, if this factor varies in the direction that the fuel evaporation from the wall surface is increased. As a factor that determines the fuel evaporation from the wall surface, the length of time during which the fuel evaporates, the fuel temperature, the wall surface temperature, or the quantity of the fuel moistening the intake distributor can be used.

SUMMARY OF THE INVENTION

It is accordingly an object of the invention to provide a method of controlling an internal combustion engine in overrun mode, which overcomes the above-mentioned disadvantages of the heretofore-known devices and methods of this general type and which, besides saving fuel, also enables a reduction in electrical energy consumption.

With the foregoing and other objects in view there is provided, in accordance with the invention, a method for controlling an internal combustion engine with a cylinder and an intake tube in overrun mode, the method which comprises:

sensing the engine for overrun mode and, when the overrun mode is detected, shutting off a fuel supply to the cylinder of the engine;

maintaining ignition after shutting off the fuel supply for a given time period, determining the given time period from a degradation of a fuel wall film present in the intake tube, and shutting off the ignition after the given time period.

In accordance with an added mode of the invention, the ignition is shut off when the fuel wall film in the intake tube has degraded completely, or it has decreased below a predetermined value.

In accordance with an additional mode of the invention, the determining step comprises determining an instant of shutoff of the ignition from operating parameters and temperature of the engine at an instant of shutoff of the fuel supply.

In accordance with a further mode of the invention, given time delays are associated with the operating parameters and the temperature, and the ignition is shut off after the given time delays have elapsed.

In accordance with a concomitant mode of the invention, the degradation of the fuel wall film is directly measured with a sensor in the intake tube or, in the alternative, it is determined by means of a wall film model.

After the shutoff of the injection immediately after detection of the overrun mode (also referred to as overrunning mode) and additional shutoff of the ignition, if the fuel wall film sticking to the inner walls of the intake tube is partly or fully removed, the reliability of the electronics can be increased by means of a reduced power loss in the ignition coil and the ignition end stages. As a result, the overall energy consumption by the engine in this operating state can be reduced.

Another advantage of the method of the invention is that the service life of the spark plugs is also increased, since the burnoff of the electrodes is determined by the number of ignition sparks generated.

An especially simple method results if, as a criterion for the conclusion of the wall film degradation, a time delay is used that is determined from engine parameters of rpm and temperature that are already available in the engine control for other control purposes.

Other features which are considered as characteristic for the invention are set forth in the appended claims.

Although the invention is illustrated and described herein as embodied in a method for controlling an internal combustion engine in the overrun mode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the figures of the drawing.

DESCRIPTION OF THE PREFERRED EMBODIMENTS

Figure 1:
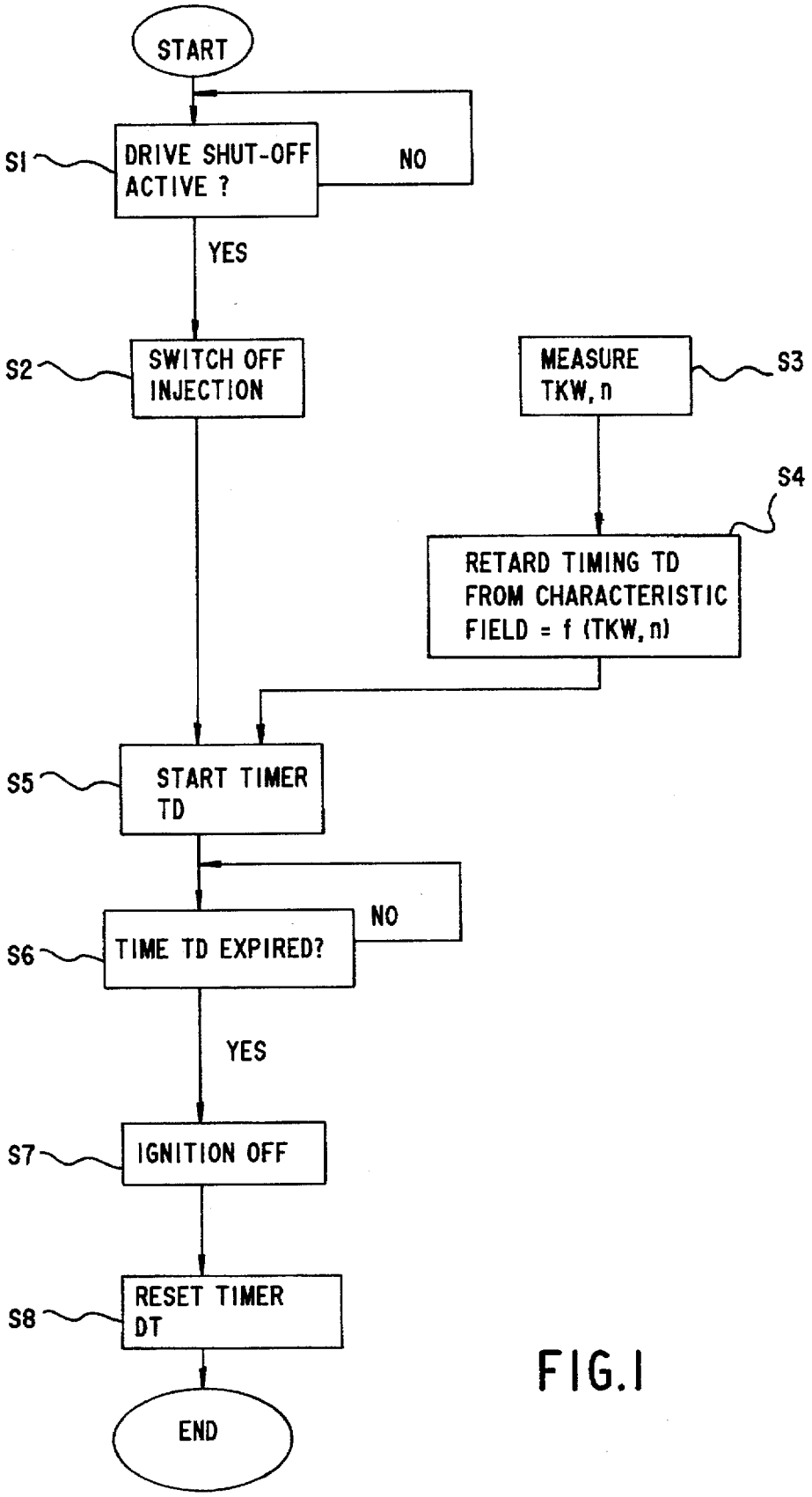
FIG. 1 is a flowchart illustrating a method of controlling an internal combustion engine in the overrun mode.

Referring now to the figures of the drawing in detail, and first, particularly, to FIG. 1 thereof, a first step S1 of the process is a query whether the engine is in the operating state of overrunning shutoff. As a criterion for this, the throttle valve opening angle and the instantaneous engine speed n can for instance be used, and these two parameters can be put in relation to one another in a conventional manner.

If an overrun mode exists, then in method step S2 the injection of the fuel is shut off by suppression of the injection pulses to the individual injection valves, in the case of multipoint injection, or to the single injection valve in the case of a single-point injection. In method step S3, at the moment of fuel shutoff, the current rpm n and the temperature of the engine, for example, are measured indirectly via the coolant temperature TKW. These two variables are the influencing factors for how rapidly the fuel wall film present in the intake tube degrades after the shutoff of the injection. Values for a time delay td are therefore stored in a performance graph of a memory of the engine control unit, as a function of the temperature and rpm. These values are ascertained empirically on the engine test bench.

In method step S4, the value for the time delay td, associated with the paired values of temperature and rpm at the moment of fuel shutoff is read out of the performance graph. After shutoff of the fuel supply, a timing element (timer) for the time delay td is started (method step S5), and then in method step S6 the question is asked constantly whether this time delay has elapsed. The repeated questioning is completed in a waiting loop. Once the time delay has elapsed, the fuel wall film in the intake tube has degraded completely, and in method step S7 the ignition is turned off. Next, in method step S8, the timer is reset, and the control process is ended.

The method according to the invention has been explained in terms of an example in which the instant of shutoff of the ignition is determined as a function of the engine temperature and rpm at the instant of fuel shutoff and as a function of a time delay correlated with it. However, it is also possible to learn the instant of complete degradation of the fuel wall film via a wall film model, as described for instance in U.S. Pat. No. 5,086,744 to Ishihara et al. (equivalent JP 5911/90 and 7934/90; DE 41 00 736 A1), or via a sensor device for determining the mass or thickness of the wall film (DE 43 23 449 A1).

In addition, the method is advantageously usable not only in an Otto engine with an injection system but can also be used in internal combustion engines with a carburetor system.

Figure 2:
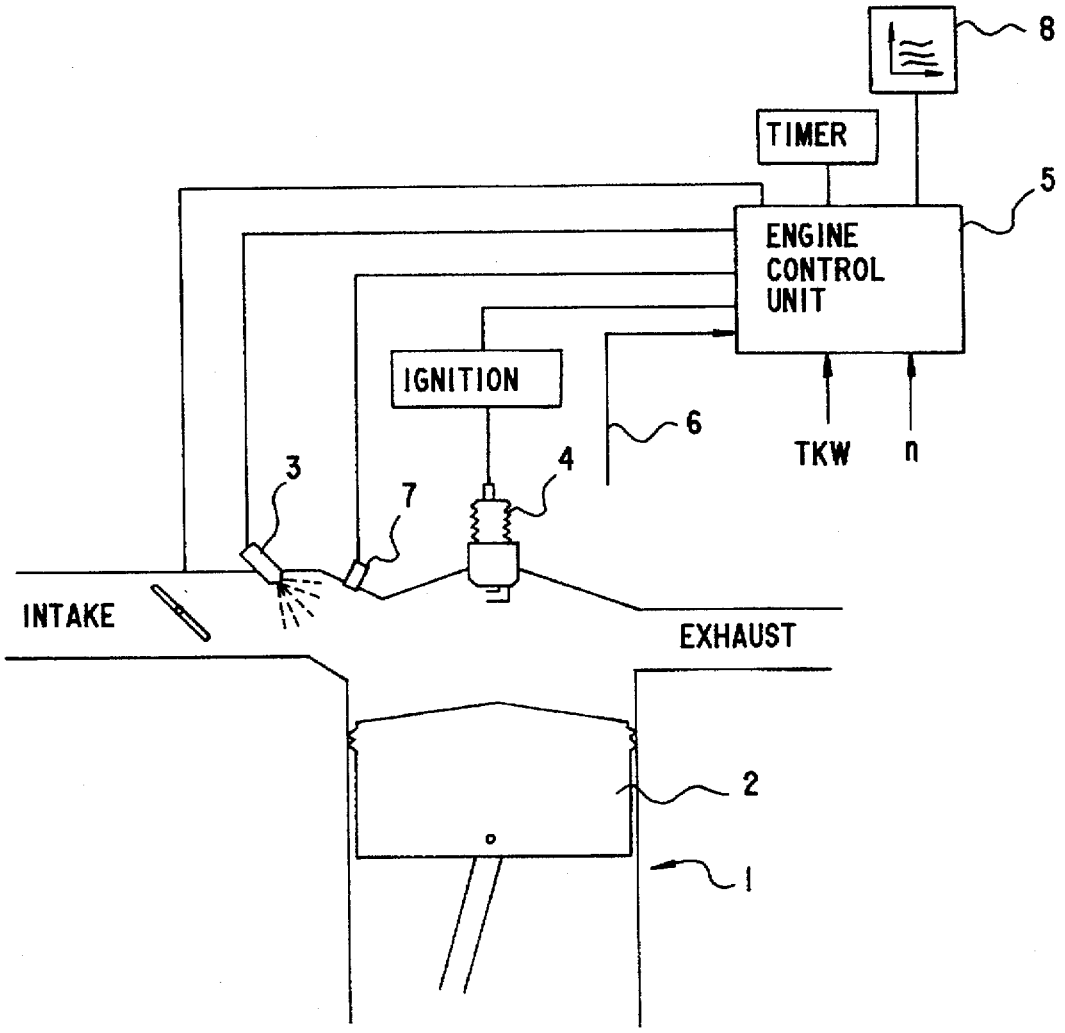
FIG. 2 is a diagrammatic illustration of a single cylinder and an associated engine control of an internal combustion engine.

The essential components of the system according to the invention are illustrated in FIG. 2. A piston 2 reciprocates within a cylinder 1. Fuel is injected at an injector 3 and the injected mixture is ignited in the cylinder head by a spark generated by a spark plug 4. The spark plug 4 is energized by an ignition system, which includes an ignition coil, ignition end stages, and the spark plug. The ignition is controlled by an engine control unit 5. The engine control unit 5 also control the fuel injection at the injector 3. A temperature of the engine is constantly measured at various locations at the engine, and the engine control unit is continuously appraised of the engine temperature at an input 6. The engine control unit is also supplied with a separate signal which is proportional to the coolant temperature TKW. In one embodiment of the invention, the wall film at the fuel intake is directly measured by a sensor 7, which relays a sensor signal to the engine control unit 5. In the alternative, the deterioration of the wall film is not directly measured by the sensor 7, but it is instead retrieved from a characteristic performance field 8 as a function of certain engine parameters. Those engine parameters are preferably the coolant temperature TKW and the current engine speed n. As noted above, the invention is not limited to the illustrated fuel-injected Otto cycle, but may be equally well adjusted to carburetor-fueled Otto engines, diesel engines or other cycles.

We claim:

1. A method for controlling an internal combustion engine with a cylinder and an intake tube in overrun mode, the method which comprises:

sensing the engine for overrun mode and, when the overrun mode is detected, shutting off a fuel supply to the cylinder of the engine;

maintaining ignition after shutting off the fuel supply for a given time period, determining the given time period from a degradation of a fuel wall film present in the intake tube, and shutting off the ignition after the given time period.

2. The method according to claim 1, which comprises shutting off the ignition when the fuel wall film in the intake tube has degraded completely.

3. The method according to claim 1, which comprises shutting off the ignition when the fuel wall film in the intake tube has decreased below a predetermined value.

4. The method according to claim 1, wherein the determining step comprises determining an instant of shutoff of the ignition from operating parameters and temperature of the engine at an instant of shutoff of the fuel supply.

5. The method according to claim 4, which further comprises associating given time delays with the operating parameters and the temperature, and shutting off the ignition after the given time delays have elapsed.

6. The method according to claim 1, wherein the determining step comprises detecting a degradation of the fuel wall film with a sensor in the intake tube.

7. The method according to claim 1, wherein the determining step comprises determining a degradation behavior of the fuel wall film with a wall film model.

* * * * *